US005600610A

United States Patent [19]

Hill et al.

[11] Patent Number: 5,600,610

[45] Date of Patent: Feb. 4, 1997

[54] ELECTROSTATIC TRANSDUCER AND METHOD FOR MANUFACTURING SAME

[75] Inventors: James A. Hill; Anthony R. H. Goodwin, both of Moscow, Id.

[73] Assignee: Gas Research Institute, Chicago, Ill.

[21] Appl. No.: 381,540

[22] Filed: Jan. 31, 1995

[51] Int. Cl.[6] ..... H04R 19/00

[52] U.S. Cl. ..... 367/181; 381/174; 381/191

[58] Field of Search ..... 367/181; 381/174, 381/191

[56] References Cited

U.S. PATENT DOCUMENTS

| | | | |
|---|---|---|---|
| 4,081,626 | 3/1978 | Muggli et al. | 179/111 |
| 4,160,881 | 7/1979 | Smulders | 179/111 E |
| 4,695,986 | 9/1987 | Hossack | 367/140 |
| 4,885,783 | 12/1989 | Whitehead et al. | 381/191 |
| 4,887,248 | 12/1989 | Griebeler | 367/181 |

OTHER PUBLICATIONS

Sell, H., "Eine neue Methode zur Umwandlung mechaniser Schwingungen in elektrische und umgekehrt," *Z. techn. Phys.*, vol. 18, p. 3, 1937.

Kuhl, W., et al., "Condenser Transmitters and Microphones with Solid Dielectric for Airborne Ultrasonics," *Acustica*, vol. 4, No. 5, pp. 515–532, 1954.

Matsuzawa, K., "Condenser Microphones with Plastic Diaphragms for Airborne Ultrasonics, I," *J. Physical Soc. of Japan*, vol. 13, Nov. 12, pp. 1533–1543, 1958..

Matsuzawa, K., "Condenser Microphones with Plastic Diaphragms for Airborne Ultrasonics, II," *J. Physical Soc. of Japan*, vol. 15, pp. 167–174, No. 1, 1960.

Wright, W. W., "High Frequency Electrostatic Transducers for Use in Gases," *IRE International Convention Board*, vol. 10, pp. 95–100, 1962.

*Primary Examiner*—J. Woodrow Eldred

*Attorney, Agent, or Firm*—Hopkins & Thomas; Scott A. Horstemeyer

[57] ABSTRACT

Electrostatic transducers (10, 100) for generating and/or sensing percussion waves have an internal rigid unitary element comprising an insulating sleeve (17, 117), an electrode backplate (21, 121) situated within the sleeve (17, 117), and a dielectric layer (22, 122) which secures the electrode backplate (21, 121) within the sleeve (17, 117). The dielectric layer (22, 122) is a generally continuous layer and has support fingers (24, 124) protruding outwardly away from the electrode backplate (21, 121) for supporting an electrode diaphragm (26, 126), preferably a durable metal foil. The electrode diaphragm (26, 126) may be hermetically sealed to a housing (111), which encloses the unitary element so that the transducers (10, 100) are better suited for harsh, extreme high/low temperature, and/or extreme high/low pressure environments. Furthermore, the interior region (32, 132) of the transducer (10, 100) can be evacuated via a throughway (31, 131) so that the transducer power can be increased.

25 Claims, 4 Drawing Sheets

ELECTROSTATIC TRANSDUCER AND METHOD FOR MANUFACTURING SAME

FIELD OF THE INVENTION

The present invention generally relates to novel electrostatic transducers which transmit and/or receive percussion waves, including for example but not limited to, sound waves, and which may be used in harsh applications over wide temperature and pressure ranges without static charge accumulation or degradation in structure.

BACKGROUND OF THE INVENTION

Percussion waves, sometimes referred to as mechanical waves, are waves which are passed through a medium, for example, water, air, etc., by way of generating a disturbance in the medium that is propagated therethrough because the medium has elastic properties.

Electrostatic transducers for generating and/or sensing percussion waves are well known in the art. Examples are illustrated in U.S. Pat. No. 4,081,626 to Muggli et al. and U.S. Pat. No. 4,695,986 to Hossack. In such transducers, a thin (often 5–10 micrometers in thickness) plastic film, which is metallized on one surface to produce an electrode, is stretched to form a diaphragm over a relatively massive metallic electrode, hereinafter termed the backplate, with the nonconductive surface of the film in contact with the backplate. The metallized surface of the film is separated by way of the insulating film from the electrode backplate so that a capacitor configuration is defined. Further, in order to provide fluid gaps for movement of the electrode diaphragm, the metal surface of the electrode backplate is textured or toughened by sanding, machining, coining, or electric discharge techniques.

In operation, when an alternating current (AC) electrical signal is superimposed on a direct current (DC) voltage bias across the aforementioned electrodes during a transmission mode of operation, the metallized film is stressed and oscillatory formations develop, thereby causing a wave front to be propagated from the film to the adjacent medium, such as water, air, etc. During a receive mode of operation, variable pressure on the diaphragm moves the film, producing a variable voltage across the electrodes which can be sensed.

The surface characteristics of the electrode backplate determine the frequency range and sensitivity of the transducer. With a very smooth, high polished surface, the frequency range can extend to about 500 kilohertz (kHz) although the sensitivity is rather low. With a surface roughened by sandblasting or other methods, or provided with grooves, the sensitivity is higher, but the upper frequency limit is lower.

Electrostatic transducers can be used for a wide variety of applications. They are currently used to stimulate and detect acoustic resonances inside chambers. Determination of certain resonance frequencies is sufficient to obtain gas phase thermophysical properties. Electrostatic transducers can also be used in industrial applications, such as flow metering, pipeline inspection, automated welding, and vehicle guidance.

While transducers constructed in accordance with the foregoing architecture provide suitable operation for many applications, they are not well suited for harsh, high temperature, and/or high pressure environments. At temperatures above 473 Kelvin (K), when exposed to certain compounds, or when exposed to certain radiation, the metallized polymer film will chemically and physically degrade. Polymers adsorb and outgas many other molecular species that contaminate any other fluid under test. Furthermore, the polymers in the films accumulate static electrical charges that render the transducer inoperative. In essence, the polymers act as an electret. In fact some systems have been developed to discharge these films. Finally, because of the manner in which the metal surface of the electrode backplate is typically textured, sharp edges exist and these sharp edges magnify the surrounding electric field, thereby creating sparks and eventually device breakdown.

Electrostatic transducers for harsh, high temperature, and/or high pressure applications are also difficult and expensive to produce on a mass commercial scale. For example, U.S. Pat. No. 4,081,626 to Muggli et al. describes an electrostatic transducer having a metallized film (metal on dielectric Kapton polymer) disposed over an electrode backplate having square groove projections for supporting the metallized film. In order to produce the square groove projections in the electrode backplate, an expensive metal working or coining process and machine must be utilized. This requirement makes this fabrication process and transducer undesirably expensive, complicated, and prohibitive in many circumstances.

As another example, consider U.S. Pat. No. 4,695,986 to Hossack. The foregoing patent describes an ultrasonic transducer also having a metallized polymer (metal on Kapton polymer) film disposed over an electrode backplate and supported by metallic protrusions extending from the electrode backplate. Although the transducer in the Hossack patent is easier to produce than the electrostatic transducer the Muggli patent, the Hossack transducer requires use of an electrochemical machining process which generates huge amounts of toxic waste. Hence, this process results in unnecessary and undesirable expense relative to disposing of the toxic wastes, and the problem is compounded as production requirements are increased.

Hence, a heretofore unaddressed need exists in the industry for an electrostatic transducer which is well suited for harsh, extreme temperature, and/or extreme pressure applications, which does not accumulate static charge or created sparks, which does not suffer from polymer decomposition or degradation, and which is easily and inexpensively manufactured on a mass commercial scale.

SUMMARY OF THE INVENTION

An object of the present invention is to overcome the inadequacies and deficiencies of the prior are as noted above and as generally known in the industry.

Another object of the present invention is to provide an electrostatic transducer which is well suited for harsh, extreme temperature, and/or extreme pressure applications.

Another object of the present invention is to provide an electrostatic transducer having a diaphragm which does not accumulate static electrical charges.

Another object of the present invention is to provide an electrostatic transducer having a diaphragm which does not degrade either chemically or physically.

Another object of the present invention is to provide an electrostatic transducer having a diaphragm which will not react with a contiguous medium.

Another object of the present invention is to provide an electrostatic transducer having textured surface for a diaphragm which will not create sparks.

Another object of the present invention is to provide a method for easily manufacturing electrostatic transducers which can be used for harsh, extreme temperature, and/or extreme pressure applications.

Another object of the present invention is to provide a method for manufacturing an extreme temperature and/or extreme pressure electrostatic transducer at lesser expense and complexity than prior art techniques.

Another object of the present invention is to provide an electrostatic transducer which is simple in design and reliable in operation.

Briefly described, the present invention is an electrostatic transducer and method for manufacturing the same. The electrostatic transducer has an insulating sleeve (e.g., ceramic, glass, crystal, polymer, etc.) situated within a housing. The insulating sleeve has a sleeve body with interconnected internal large and small chambers, both of which are preferably cylindrical in circumference. The large chamber is larger in diameter than the small chamber, and the chambers have respective central axes which are aligned. A conductive electrode backplate (e.g., titanium alloy, kovar, etc.) is designed to slidably engage and mate with the insulating sleeve. The electrode backplate comprises interconnected large and small portions, both of which are preferably cylindrical, which engage the large and small chambers respectively of the sleeve. Once the electrode backplate is positioned within the insulating sleeve, the electrode backplate has opposing exposed surfaces, one referred to as the biasing surface and the other referred to as an electrical contact surface.

A dielectric layer (e.g., ceramic, glass, crystal, polymer, epoxy, enamel, etc.) having inner and outer surfaces is positioned over the electrode backplate. The inner surface is generally continuous over and contiguous with the biasing surface of the electrode backplate, and preferably, the dielectric layer secures the electrode backplate within the confines of the insulating sleeve by overlapping the electrode backplate onto the edges of the sleeve. The outer surface of the dielectric layer has support fingers which protrude outwardly in a direction away from the electrode backplate. In accordance with a significant feature of the present invention, the combination of the sleeve, the electrode backplate, and the dielectric layer establish a rigid unitary element which can be hermetically sealed, if desired.

Furthermore, an electrode diaphragm (e.g., aluminum foil) is disposed over the support fingers so that the electrode diaphragm is adjacent to and separated from the biasing surface of the electrode backplate. With the electrode diaphragm disposed over the support fingers, volumes of gas (preferably air) are trapped between the dielectric layer and the overlying electrode diaphragm. This configuration permits the electrode diaphragm to move in a direction toward and away from the underlying dielectric layer so that the electrode diaphragm interfaces percussion waves with an adjacent medium. An electrical bias can be generated and sensed between the biasing surface of the electrode backplate and the electrode diaphragm based upon movement of the electrode diaphragm relative to the biasing surface.

When the electrostatic transducer is manufactured, the dielectric layer may be advantageously applied using simple and inexpensive methods. For example, the dielectric layer may be applied by first disposing solid particles on the biasing surface and then melting the solid particles while residing on the biasing surface. As another example, the dielectric layer could also be applied by spraying a polymer having solid particles onto the biasing surface.

In addition to achieving all of the aforementioned objects, the present invention has numerous other advantages, a few of which are delineated hereafter.

An advantage of the present invention is that the transducers can withstand an environment having a pressure approximately between vacuum and 70 Mega Pascal (MPa) and/or a temperature of approximately between 80K and 770K.

Another advantage of the present invention is that the sleeve, the internally enclosed electrode backplate, and the dielectric layer of the transducers form a mechanically rigid unitary element which provides for accurate transducer aiming, and the unitary element can be used in transducers that must maintain a precise calibration over an extended period of time.

Another advantage of the present invention is that the transducers can be manufactured via a simple spraying process, which is much less expensive than prior art methods and which requires only a small investment in equipment. Further, a spraying process also produces a more uniform product than other known processes.

Another advantage of the present invention is that the electrode diaphragm can be hermetically sealed to a housing which contains the mechanical rigid unitary element having the combination of the sleeve, electrode backplate, and dielectric layer. By sealing the housing interior and evacuating it, the transducer power can be increased, and furthermore, the sealed transducer can be used in severely harsh environments, including for example but not limited to, submersion in reactive liquids.

Another advantage of the present invention is that the electrostatic transducer can be manufactured without the need for a spring and put together with simple compression.

Other objects, features, and advantages of the present invention will become apparent to one with skill in the art upon examination of the drawings and the following detailed description. All such additional objects, features and advantages are intended to be included herein within this disclosure.

BRIEF DESCRIPTION OF THE DRAWINGS

The present invention can be better understood with reference to the following drawings. The drawings are not necessarily to scale, emphasis instead being placed upon clearly illustrating principles of the present invention.

DETAILED DESCRIPTION OF THE PREFERRED EMBODIMENTS

Figure 1:
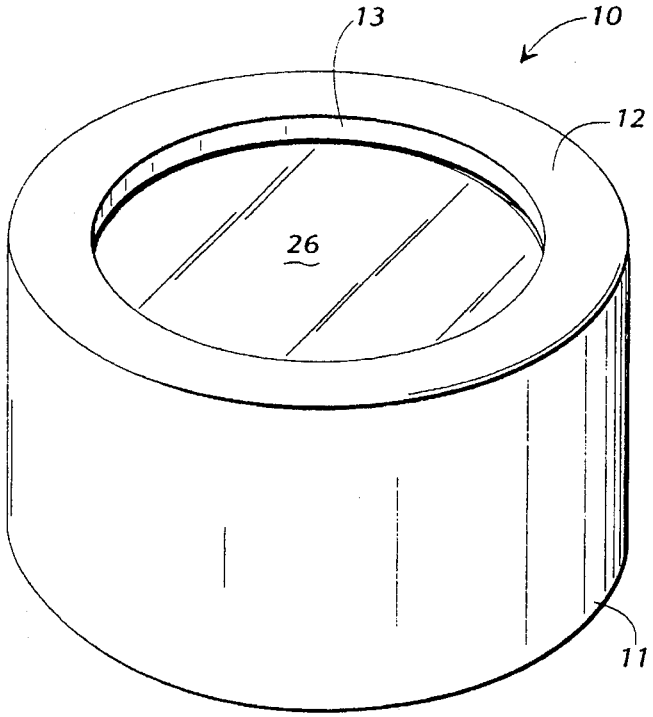
FIG. 1 is a perspective view of an electrostatic transducer in accordance with a first embodiment of the present invention.

With reference now to the drawings wherein like reference numerals designate corresponding parts throughout the several views, FIGS. 1 through 4 illustrate a first embodiment of an electrostatic transducer, generally denoted by reference numeral 10, in accordance with the present invention. The electrostatic transducer 10 has a housing 11, preferably cylindrical in shape although certainly not limited to this geometrical configuration, having an annular lip 12 situated about an opening 13 at one end and internal female threads 14 at the opposing end for receiving a male threaded O-ring retainer 16 in mating engagement. The housing 11 and the O-ring retainer 16 are manufactured from any suitable material, including, for example but not limited to, metal (e.g., aluminum, steel, teflon), plastic, etc. The materials should meet the desired temperatures and/or pressure requirements. In the preferred embodiment, the housing 11 and O-ring retainer 16 are produced from steel.

As shown in FIGS. 1 through 4, the housing 11 encloses a rigid unitary element comprising an insulating sleeve 17, an electrode backplate 21, and a dielectric layer 22. The sleeve 17, preferably but not limited to ceramic, has a body with interconnected internal large and small chambers 17*a*, 17*b*, respectively, both of which are preferably cylindrical in shape. It should be mentioned that other possible materials for constructing the sleeve 17 include glass, crystal, and polymer. The large chamber 17*a* has a disk-like configuration and is larger in diameter than the small chamber 17*b*, and the chambers 17*a*, 17*b* have respective central axes which are generally aligned. The electrode backplate 21, preferably metal with a similar thermal expansion to the dielectric layer 22, for example but not limited to, titanium alloy, kovar (low expansion metal), etc., has interconnected large and small portions 21*a*, 21*b*, both of which are preferably cylindrical and are interconnected along a common axis, which engage the large and small chambers 21*a*, 21*b* respectively of the sleeve 17. Once the electrode backplate 21 is positioned within the sleeve 17, the electrode backplate 17 has opposing surfaces 23*a*, 23*b* exposed from the sleeve 17, one referred to herein as the biasing surface 23*a* and the other referred to herein as an electrical contact surface 23*b*.

Figure 3:
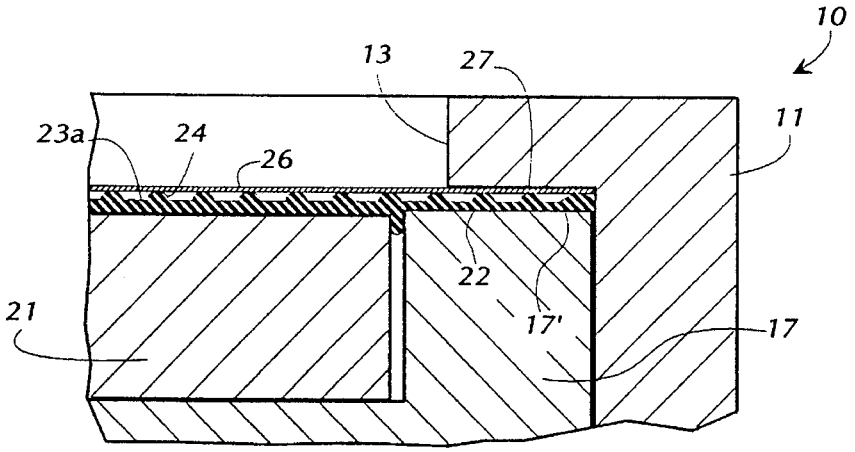
FIG. 3 is a partial exploded view of the junction among the dielectric layer, the electrode backplate, and sleeve of FIG. 2 for illustrating construction of a single unitary element and for illustrating support fingers protruding from the dielectric layer.
Figure 4:
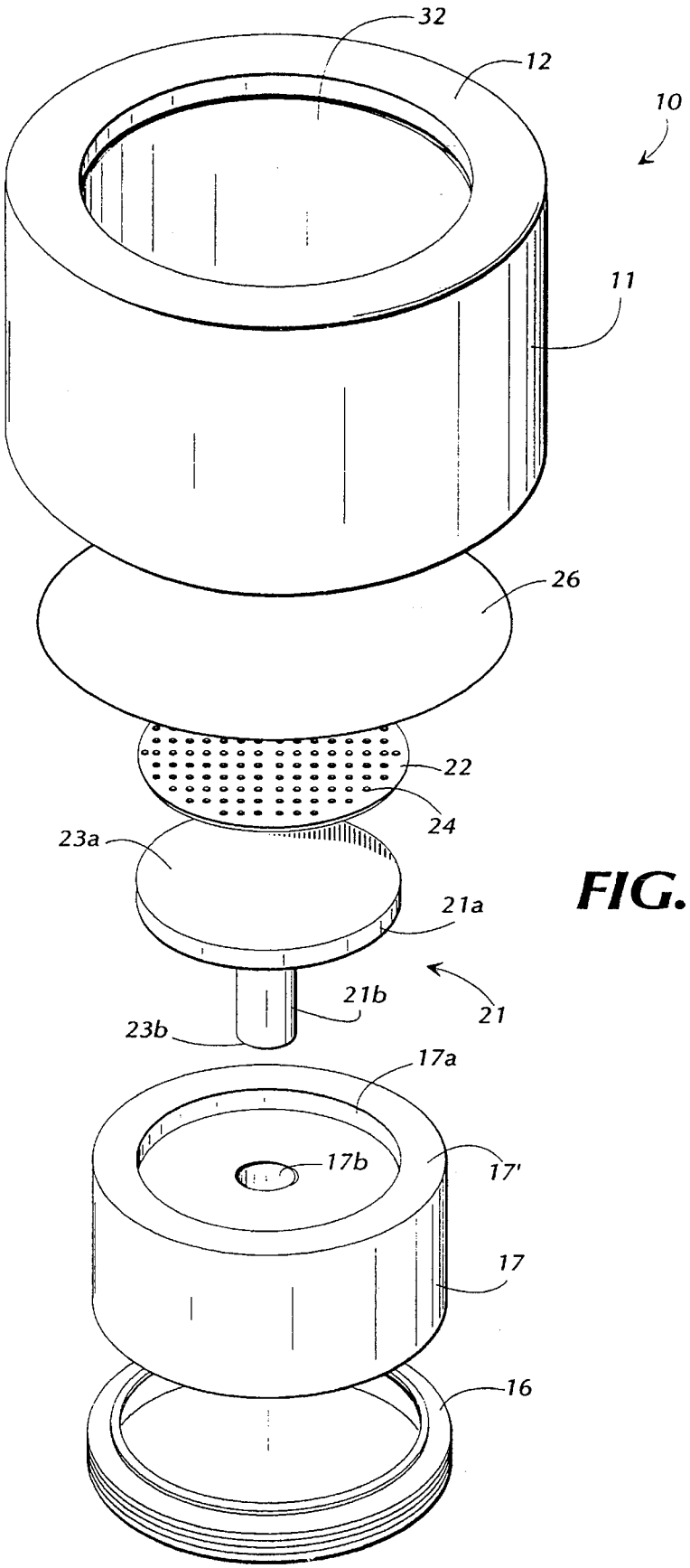
FIG. 4 is an assembly view of the electrostatic transducer of FIGS. 1 through 3.
Figure 5:
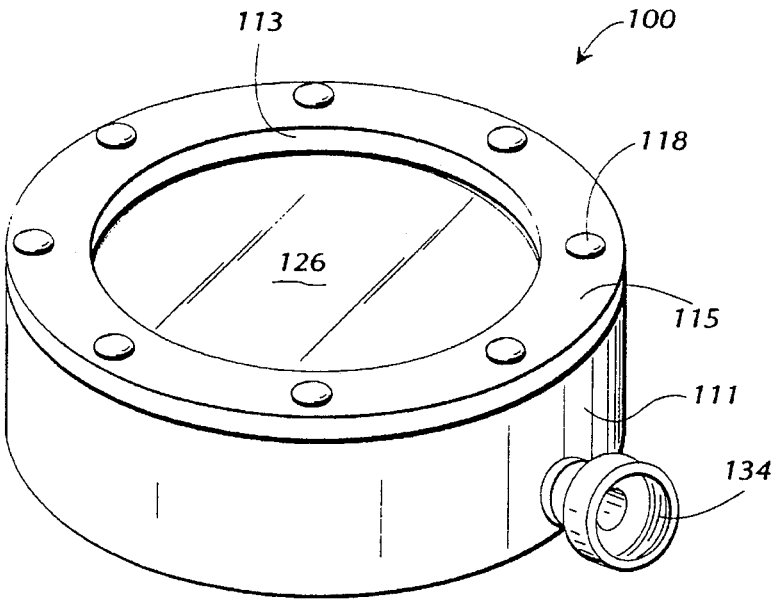
FIG. 5 is a perspective view of an electrostatic transducer in accordance with a second embodiment of the present invention.
Figure 6:
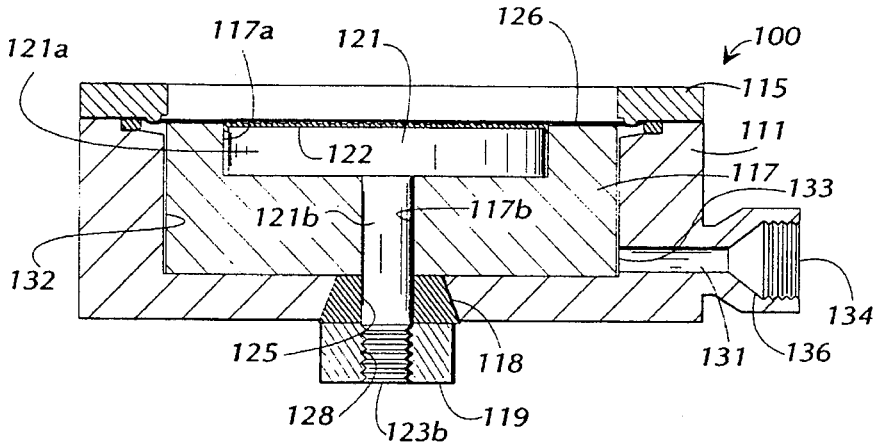
FIG. 6 is a cross-sectional view of the electrostatic transducer of FIGS. 4 and 5.

The dielectric layer 22 is situated over the biasing surface 23*a* of the electrode backplate 21 and, preferably but not necessarily, spans over the line of demarcation between the electrode backplate 21 and the sleeve 17 and onto a portion of the sleeve 17, as shown in FIG. 3. In the preferred embodiment, the dielectric layer 22 is bonded to the surface 23*a* of the electrode backplate 21 and a surrounding portion of the sleeve 17 so that the electrode backplate 21 is securely maintained within the sleeve 17 and so that the combination of the sleeve 17, electrode backplate 21, and dielectric layer 22 form the rigid unitary element. Furthermore, the dielectric layer 22 can be any suitable insulating material, including for example but not limited to, ceramic, glass, crystal, polymer, epoxy, enamel, etc.

In the preferred embodiment, the electrode backplate 21 and the sleeve 17 are configured so that the top surface 17' of the sleeve 17, as illustrated in FIG. 3, extends slightly above the biasing surface 23*a* of the electrode backplate 21. With this configuration, the process for applying a dielectric layer 22 is simplified, and the insulation at the periphery edge of the surface 23*a* of the electrode backplate 21, which is where electric field concentration occurs, is desirably enhanced.

As further shown in FIG. 3, the dielectric layer 22 has a plurality of support fingers 24, which protrude upwardly in a direction away from the electrode backplate 21 and which are designed to support an overlying electrode diaphragm 26. The support fingers 24 generally exhibit a mesa or hemisphere configuration and are preferably dispersed uniformly throughout the surface of the dielectric layer 22.

Significantly, the dielectric layer 22 is formed over the biasing surface 23*a* of the electrode backplate 21 using simple and inexpensive fabrication techniques. For example, the dielectric layer 22 may be applied by first disposing solid particles on the biasing surface 23*a* and then melting, to a large extent, the solid particles while residing on the biasing surface 23*a* so that a continuous surface layer with intermittent upwardly protruding fingers is realized. The melting of the solid particles is performed by annealing, or baking, the particles, while residing on the electrode backplate 21 and sleeve 11. As an example, the melting can be accomplished by baking the particles in a conventional oven at about 830K for about 9 minutes. Obviously, many other types of heating sources, other temperatures, and other heating time periods could be utilized to accomplish the desired aforementioned end product.

The dielectric layer 22 can also be applied by a simple spraying process wherein a generally liquified carrier having solid particles is sprayed onto the biasing surface 23*a*. The carrier with solid particles may then be cured and solidified, if necessary, by an annealing, or baking, process. If an epoxy is utilized to form the dielectric layer 22, the dielectric layer 22 can be cured in open air. If an enamel is utilized to form the dielectric layer 22, then annealing may be required. A spraying process is desirable because it is inexpensive and requires only a small investment in equipment. This deposition method also produces a uniform product.

The electrode diaphragm 26 is preferably a durable metal foil, for example but not limited to, aluminum foil. However, the electrode diaphragm 26 may be a metallized film, for instance, metal on plastic, polymer, polyamide, Kapton, Mylar, Teflon, Kimfol, Kimfone, etc. Metallized films are well known in the art and used in many prior art embodiments. Suitable metallized films are described in U.S. Pat. No. 4,081,626 to Muggli et al. and U.S. Pat. No. 4,695,986 to Hossack, the disclosures of which are incorporated herein by reference.

A metal foil is preferred for the electrode diaphragm 26 for various reasons. A metal foil is much less expensive than metallized film. A metal foil is stronger than plastic. A metal foil is impregnable to liquids and gases. A metal foil is more durable and better suited to harsh, extreme high/low temperature, and/or extreme high/low pressure environments. A metal foil does not accumulate static charge, as would a metallized polymer film, and therefore require discharge. Finally, a metal foil can be hermetically sealed to the housing 11 so that the transducer 10 is completely sealed from the adjacent medium where percussion waves are communicated.

The transducer 10 is connected to electrical support circuitry (not shown) which may take various configurations, many of which are well known in the art. Suffice it to say, an electrical connection (not shown) is interfaced to the surface 23*b* of the electrode backplate 21 and a return, common, or ground electrical connection (not shown) is interfaced to the housing 11, which is electrically connected to the electrode diaphragm 26. When the transducer 10 is in a receive mode of operation, an electrical bias (or electric field) can be generated between the biasing surface 23*a* of the electrode backplate 21 and the electrode diaphragm 26 upon movement of the electrode diaphragm 26 caused by a contiguous medium, for example, but not limited to, air, water, etc., and the electrical bias (or electric field) can be sensed by the aforementioned electrical connections. When the transducer 10 is in a transmission mode of operation, an electrical bias (or electric field) can be generated between the biasing surface 23*a* of the electrode backplate 21 and the electrode diaphragm 26 by electrical inducement from the aforementioned electrical connections so that the electrode diaphragm 26 is caused to move, and this movement generates percussion waves in the contiguous medium.

The transducer 10 is well suited for environments having a pressure approximately between vacuum and 70 Mega Pascal (MPa) and/or a temperature of approximately between 80K and 770K. In fact, in the foregoing environments, with the transducer 10 biased to 300 volts DC, the transducer 10 has a –97 dB voltage-to-voltage response at the first radial mode of Argon in a conventional spherical resonator, 45 mm in radius, at atmospheric pressure.

FIGS. 4 through 8 illustrate a novel electrostatic transducer 100 in accordance with a second embodiment of the present invention. The transducer 100 is similar in structure and operation to the transducer 10, but the transducer 100 includes certain additional novel features which make the transition 100 more desirable for some applications. In particular, the transducer 100 is easily manufactured on a mass commercial scale, has an efficient and reliable means for hermetically sealing the transducer housing, and has a means for evacuating or equalizing pressure within the transducer housing. Unless specifically addressed hereafter to the contrary, the features of the transducer 100 are the same as those of the transducer 10 and are incorporated herein along with any associated discussion as set forth previously.

Figure 7:
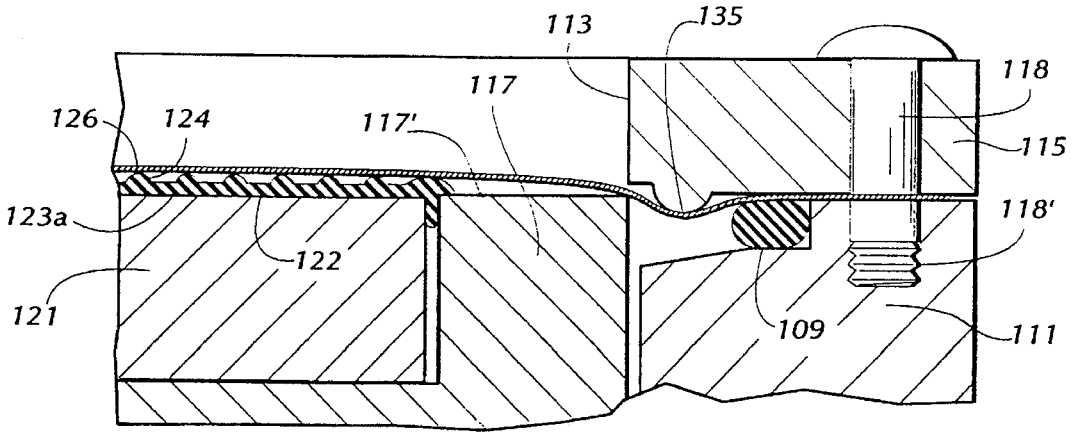
FIG. 7 is a partial exploded view of the junction among the dielectric layer, the electrode backplate, and sleeve of FIG. 6 for illustrating construction of a single unitary element and for illustrating support fingers protruding from the dielectric layer.
Figure 8:
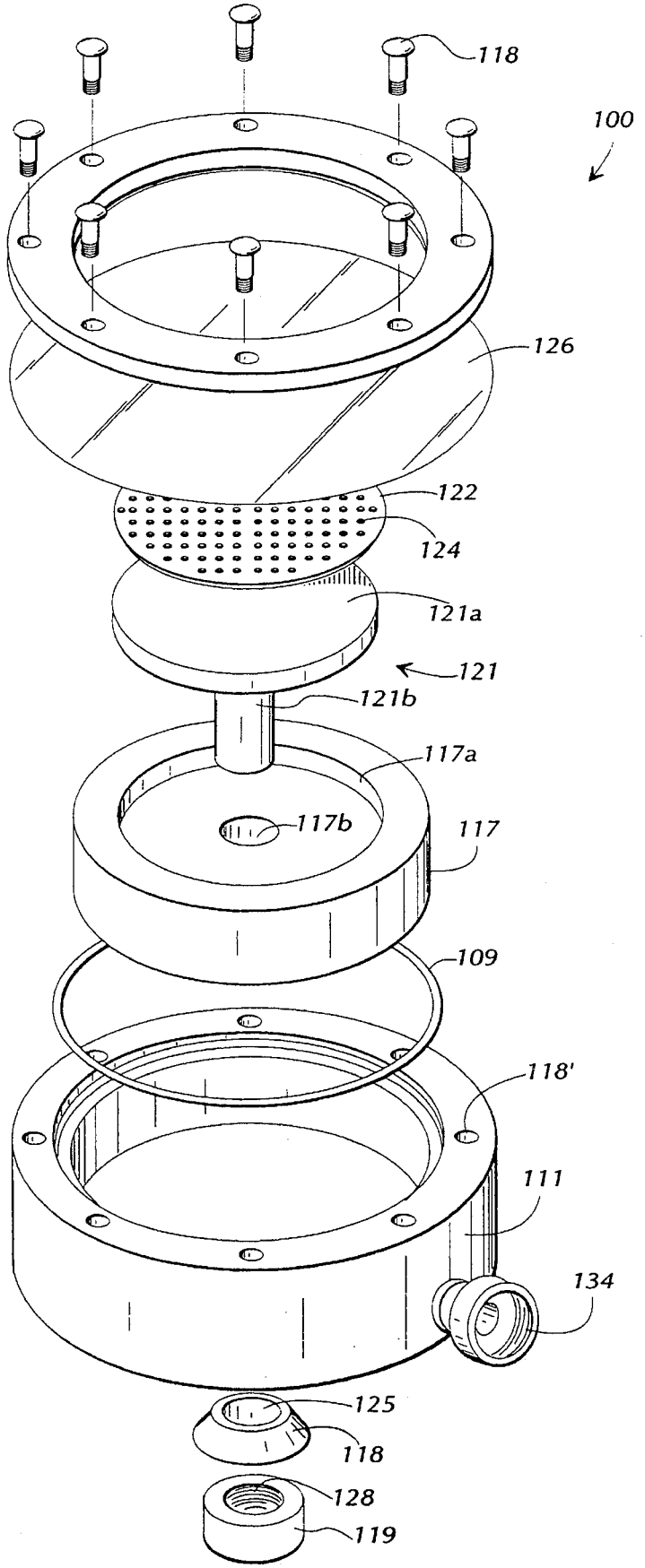
FIG. 8 is an assembly view of the electrostatic transducer of FIG. 4.

In structure, the transducer 100 has a cylindrical housing 111 with a circular diaphragm O-ring retainer 115 mounted at one end of the housing 111. The diaphragm O-ring retainer 115 is mounted to the housing 111 via a plurality of threaded screws 118 which pass through the diaphragm O-ring retainer 115 into threaded apertures 118' situated within the housing 111. The O-ring retainer 115 may optionally be provided with an outwardly protruding tensioning tongue 135 for tensing the metal foil 126, as is shown in FIG. 7. Furthermore, the diaphragm O-ring retainer 115 is sealed to the housing 111 via a circular O-ring seal 109, as shown in cross section at FIG. 7, which is made of rubber, nylon, or another suitable material for hermetically sealing the retainer 115 to the housing 111.

Figure 2:
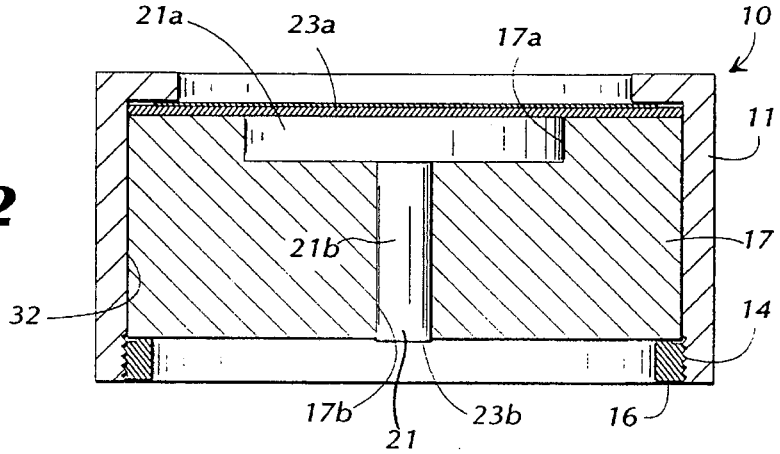
FIG. 2 is a cross-sectional view of the electrostatic transducer of FIG. 1.

At the other end of the housing 111 is situated a tapered aperture 118 for receiving in mating engagement a male tapered bushing 118 having a smooth internal bore hole 125 therein. The bushing 118 is held within the tapered aperture 118 via a threaded nut 119 with internal threads 128. The nut 119 is secured via threaded engagement to the electrode backplate 121, as is best shown in FIG. 2.

The O-ring retainer 115, screws 118, electrode diaphragm 126, cylindrical housing 111, bushing 118, nut 119, and electrode backplate 121 are produced from any suitable material, depending upon the environment requirements. In the preferred embodiment, these elements are produced from steel and protect the transducer 100 sufficiently so that the transducer 100 can withstand an environment having a pressure approximately between vacuum and 70 Mega Pascal (MPa) and/or a temperature of approximately between 80K and 770K.

Similar to the first embodiment, the transducer 100 further comprises a cylindrical sleeve 117 having a large chamber 117*a* interconnected with a small chamber 117*b*. The diameter of the large chamber 117*a* is larger than the diameter of the small chamber 117*b*.

An electrode backplate 121 is configured to be received by the sleeve 117 and has a large portion 121*a* and a small portion 121*b*, both of which are preferably cylindrical and are generally aligned along a common axis. The large and small portions 121*a*, 121*b* are configured to engage and mate with the large and small chambers 117*a*, 117*b* of the sleeve 117. Further, the downwardly extending small portion 121*b* of the electrode backplate 121 is threaded at its distal end so that the small portion 121*b* can be screwed into the nut 119.

A dielectric layer 122 is disposed over a biasing surface 123*a* of the electrode backplate 121 and, preferably but not necessarily, is disposed over a portion of the surrounding sleeve 117 situated about the periphery of the electrode backplate 121, as is best illustrated in the view of FIG. 7. The dielectric layer 122 is constructed and disposed in generally the same manner as the dielectric layer 22 relative to the electrostatic transducer 10 of the first embodiment. Hence, the sleeve 117, electrode backplate 121, and dielectric layer 122 form a single rigid unitary element.

Similar to the first embodiment, in the preferred embodiment of the transducer 100, the electrode backplate 121 and the sleeve 117 are configured so that the top surface 117' of the sleeve 117, as shown in FIG. 7, extends slightly above the biasing surface 123*a* of the electrode backplate 121. With this configuration, the process for applying a dielectric layer 122 is simplified, and the insulation at the periphery edge of the surface 123*a* of the electrode backplate 121, which is where electric field concentration occurs, is enhanced.

In order to permit evacuation of gases from the internal region of the transducer 100 or to permit pressure equalization by insertion of gases into the internal region, a throughway 131 is provided for interconnecting the interior chamber 132 of the housing 111 with an external device (not shown). The external device can be, for instance, a vacuum source for evacuating gases or a gas generator for producing gases, perhaps inert gases. The throughway 131 is preferably a cylindrical channel having an orifice 133 at one end leading to the chamber 132 and a threaded orifice 134 situated at the other end for connecting to the external device. In the preferred embodiment, the throughway 131 has an expansion region 136 for decreasing the pressure ratio between the orifices 133, 134.

It should be noted that by sealing the interior region and evacuating it, the transducer power can be increased and the rigidity of the transducer 100 is enhanced for better aiming capabilities.

Finally, it will be obvious to those skilled in the art that many variations and modifications may be made to the preferred embodiments as described above without substantially departing from the spirit and scope of the present invention. It is intended that all such variations and modifications be included within the scope of the present invention, as set forth in the following claims.

Wherefore, the following is claimed:

1. An apparatus for an electrostatic transducer for percussion waves, comprising:

an inner electrode having a biasing surface;

a dielectric layer substantially covering said inner electrode and having inner and outer surfaces, said inner surface being substantially continuous and contiguous with said biasing surface, said biasing surface, said outer surface having protruding support fingers; and an outer electrode layer being supported by said support fingers in a position adjacent to and separated from said biasing surface, said outer electrode layer for interacting percussion waves in an adjacent medium by movement of said moveable outer electrode relative to said inner electrode;

whereby an electrical bias can be generated and sensed between said biasing surface and said outer electrode layer based upon said movement of said outer electrode layer relative to said inner electrode.

2. The apparatus of claim 1, further comprising an insulating sleeve situated about said inner electrode and wherein the combination of said sleeve, said inner electrode, and said dielectric layer is a rigid unitary element.

3. The apparatus of claim 1, wherein said outer electrode layer is a metal foil.

4. The apparatus of claim 1, wherein said dielectric layer is ceramic.

5. The apparatus of claim 2, wherein said dielectric layer covers and is bonded to said biasing surface and a portion of said sleeve situated about a periphery of said biasing surface.

6. The apparatus of claim 2, wherein said combination is hermetically sealed.

7. The apparatus of claim 3, further comprising a housing for containing a combination of said inner electrode, said outer electrode, and said dielectric layer and wherein said combination is hermetically sealed within said housing relative to said medium.

8. An electrostatic transducer for percussion waves, comprising:

a housing;

an insulating sleeve situated within said housing, said sleeve comprising a sleeve body with interconnected internal large and small chambers, said large chamber being larger in diameter than said small chamber;

a conductive electrode backplate comprising interconnected large and small portions, said large portion being larger in diameter than said small portion, said large and small portions disposed in mating engagement with said large and small chambers of said sleeve respectively, said electrode backplate having a biasing surface and an electrical contact surface on said large and small portions respectively and exposed from said sleeve;

a dielectric layer having inner and outer surfaces, said inner surface being generally continuous and contiguous with said biasing surface of said electrode backplate, said outer surface having support fingers protruding outwardly;

wherein said sleeve, said electrode backplate, and said dielectric layer in combination establish a rigid unitary element; and a conductive electrode diaphragm being supported by said support fingers adjacent to and separated from said biasing surface, said electrode diaphragm being connected to said housing, said electrode diaphragm for interfacing percussion waves with a medium;

whereby an electrical bias can be generated between said biasing surface and said electrode diaphragm and sensed between said electrical contact surface and said housing based upon movement of said electrode diaphragm relative to said biasing surface.

9. The transducer of claim 8, wherein said electrode diaphragm is hermetically sealed to said housing.

10. The transducer of claim 8, wherein said combination is hermetically sealed relative to said medium.

11. The transducer of claim 8, wherein said electrode diaphragm is a metal foil.

12. The transducer of claim 8, wherein said dielectric layer is produced from the group consisting of ceramic, glass, crystal, polymer, epoxy, and enamel.

13. The transducer of claim 8, wherein said sleeve is produced from the group consisting of ceramic, glass, crystal, and polymer, and wherein said electrode backplate is produced from metal.

14. The transducer of claim 8, wherein said sleeve, said electrode backplate, and said electrode diaphragm are constructed of materials sufficient for communicating waves with a chamber having a pressure approximately between vacuum and 70 Mega Pascal (MPa).

15. The transducer of claim 8, wherein said sleeve, said electrode backplate, and said electrode diaphragm are constructed of materials sufficient for communicating waves with a chamber having a temperature of approximately between 80K and 770K.

16. The transducer of claim 8, wherein said dielectric layer covers and is disposed over said biasing surface and a portion of said sleeve situated about a periphery of said biasing surface.

17. The transducer of claim 8, wherein said portion of said sleeve extends above said biasing surface.

18. In an electrostatic transducer for percussion was, said transducer having an internal electrode for providing an electrical bias relative to a conductive electrode diaphragm, the improvement comprising a dielectric material interposed between said electrode and said electrode diaphragm, said dielectric material being substantially continuous and contiguous with said internal electrode so as to cover said internal electrode and to electrically isolate said electrode diaphragm from said internal electrode, while permitting an electric field to be established therebetween, and having support fingers for supporting said electrode diaphragm to permit movement of said electrode diaphragm in a direction toward and away from said internal electrode.

19. A method for producing an electrostatic transducer for percussion waves, comprising the steps of:

providing an inner electrode having a biasing surface;

forming a substantially continuous dielectric layer on said biasing surface having outwardly protruding fingers, said dielectric layer formed so as to substantially cover said biasing surface; and disposing an outer electrode layer on said fingers of said dielectric layer, said outer electrode layer for communicating percussion waves.

20. The method of claim 19, wherein said step of forming comprises the steps of:

applying solid particles to said biasing surface; and melting said solid particles while residing on said biasing surface.

21. The method of claim 19, wherein said step of forming comprises the step of spraying a polymer having solid particles onto said biasing surface.

22. The method of claim 19, wherein said outer electrode layer is a metal foil.

23. The method of claim 19, further comprising the steps of:

surrounding a periphery of said biasing surface with a sleeve; and covering said biasing surface and a portion of said sleeve surrounding said periphery with said dielectric layer.

24. An apparatus for an electrostatic transducer for percussion waves, comprising:

an inner electrode having a biasing surface;

a dielectric layer having inner and outer surfaces, said inner surface being substantially continuous and contiguous with said biasing surface, said outer surface having protruding support fingers; and an outer electrode layer being supported by said support fingers in a position adjacent to and separated from said biasing surface, said outer electrode layer for interacting percussion waves in an adjacent medium by movement of said moveable outer electrode relative to said inner electrode; and an insulating sleeve situated about said inner electrode and wherein the combination of said sleeve, said inner electrode, and said dielectric layer is a rigid unitary element, said sleeve comprising a sleeve body with interconnected internal large and small chambers, said large chamber being larger in diameter than said small chamber;

wherein said inner electrode comprises interconnected large and small portions, said large portion and small portions being configured for mating engagement with said large and small chambers of said sleeve respectively.

25. The apparatus of claim 24, wherein said portion of said sleeve extends above said biasing surface.

* * * * *